US005823443A

United States Patent [19]

Cooper et al.

[11] Patent Number: 5,823,443

[45] Date of Patent: Oct. 20, 1998

[54] POPPET NOZZLE FOR FUEL INJECTION

[75] Inventors: Richard Lloyd Cooper, Le Roy; Michael Raymond Salemi, Rochester; Albert Martin Knebel, Holcomb, all of N.Y.

[73] Assignee: General Motors Corporation, Detroit, Mich.

[21] Appl. No.: 772,397

[22] Filed: Dec. 23, 1996

[51] Int. Cl.[6] ..... F02M 55/02

[52] U.S. Cl. ..... 239/533.9; 239/533.12

[58] Field of Search ..... 239/533.12, 533.9, 239/533.3, 570, 596; 137/269, 284.2, 284.4

[56] References Cited

U.S. PATENT DOCUMENTS

| | | | |
|---|---|---|---|
| 2,154,875 | 4/1939 | Streby | 239/452 X |
| 2,162,892 | 6/1939 | Rotter | 137/469 X |
| 2,172,556 | 9/1939 | Edwards | 239/452 |
| 3,249,308 | 5/1966 | Cadiou | 239/453 |
| 4,270,257 | 6/1981 | Kimata et al. | 239/453 X |
| 4,511,082 | 4/1985 | Ballik et al. | 239/453 X |
| 4,907,748 | 3/1990 | Gardner et al. | 239/596 X |

*Primary Examiner*—Kevin Weldon

*Attorney, Agent, or Firm*—Karl F. Barr, Jr.

[57] ABSTRACT

A fuel system including a fuel nozzle is disclosed. The fuel nozzle is adapted to receive pulsed pressurized fuel from a source and includes a valve seat assembly having a valve seat body with a longitudinally extending passage. The passage of the valve seat body has a valve seat extending thereabout and interfaces with a downstream opening valve element which is disposed within the longitudinally extending passage and operates to move into and out of sealing engagement with the valve seat to regulate the flow of pressurized fuel though the passage. The valve element has a spherically configured upstream surface for sealing engagement with the valve seat which includes an annular drag groove extending thereabout. The drag groove functions to increase viscous drag force, in the downstream opening direction, which is imparted on the valve element by fuel flow over the spherical upstream surface. The nozzle also has an annular, fuel directing orifice disc which is disposed downstream of the valve seat. The orifice disc includes fuel directing orifices which extend therethrough from a first, upstream side to a second downstream side. The annular fuel directing orifice disc limits downstream movement of the valve member and directs fuel through the orifices into a desired fuel pattern.

5 Claims, 4 Drawing Sheets

POPPET NOZZLE FOR FUEL INJECTION

TECHNICAL FIELD

This invention relates to a nozzle for discharge of fuel to the intake system of an internal combustion engine.

BACKGROUND OF THE INVENTION

In the fuel injection system set forth in U.S. Pat. No. 5,070,845 issued Dec. 10, 1991 to Avdenko et al., a fuel system is disclosed having an injector for metering fuel to a plurality of fuel injection nozzles. Fuel is distributed through individual fuel lines and is discharged, via the nozzles, at locations adjacent to the intake ports of an associated internal combustion engine. The nozzle disclosed in Avdenko et al. has a body with a tubular seat member having a valve seat defining an opening for the passage of fuel therethrough. A poppet valve member is operable, relative to the valve seat, to interrupt fuel flow through the opening and an extension spring anchored to the valve member and to the nozzle body urges the valve member into a normally seated position against the valve seat.

The nozzle body is adapted to receive fuel through an inlet and may include a restriction which operates to limit fuel flow through the nozzle. In the disclosed fuel injection nozzle the poppet valve member lacks the capability to meter fuel flow through the valve seat since it can not act as a fixed orifice. As a result, the fuel flow through the fuel nozzle is sensitive to variations in fuel system pressure.

SUMMARY OF THE INVENTION

The invention is directed to a fuel injection nozzle which is suitable for use as part of a fuel delivery system for an internal combustion engine in which fuel, under pressure, is delivered to a nozzle.

In a fuel injection nozzle according to the present invention, a tubular nozzle body is adapted to receive fuel from a pressurized source through an inlet. The nozzle body includes a fuel passage for the pressurized fuel in which is disposed a valve seat that is operable, with an outward opening poppet valve member, to interrupt the flow of fuel through the passage under the urging of an extension spring. Introduction of a high-pressure pulse of fuel to the nozzle body, through the inlet, will cause the valve member to move towards an open position, off of the valve seat to define a flow path for fuel through the injector. As the poppet valve member moves off of the valve seat under the urging of the fuel pulse, it moves in a downstream direction allowing fuel to flow through an annular opening defined between the valve member and the valve seat. Further movement in the downstream, open direction is arrested by an annular, downstream, fuel directing poppet stop which receives the downstream end of the poppet valve in a sealing relationship causing the fuel passing through the annular fuel opening to be distributed across the upstream surface of the stop. Fuel orifices extend through the annular, downstream, fuel directing poppet stop and provide a passage for fuel out of the poppet nozzle. The fuel directing orifices are placed about the circumference of the fuel directing poppet stop and oriented to precisely control the fuel pattern discharged from the nozzle.

To assure rapid opening and precise positioning of the poppet valve, relative to the annular, downstream, fuel directing stop, the fuel directing poppet stop includes a large central opening which receives the lower or downstream end of the poppet valve element. The valve element preferably includes a positioning stub for precise positioning of the valve member within the central opening.

In addition, the valve element may include an annular drag ring about its upstream surface. To minimize flow variation or inconsistencies in fuel delivery, it is desirable that the valve member opens off of the valve seat and subsequently seats against the fuel directing stop as rapidly as possible. Increasing the opening force with which the fuel acts on the poppet valve will facilitate an increase in the opening rate of the nozzle. The flow disrupting, annular drag ring which extends about the circumference of the valve ball, "catches" the fuel as it passes over the ball surface. The disruptive action of the ring on the fuel flow pattern over the valve operates to increase the fluid force on the valve in the opening direction.

These and other objects and features of the invention will become apparent by reference to the following description and to the drawings.

DESCRIPTION OF THE PREFERRED EMBODIMENT

Figure 1:
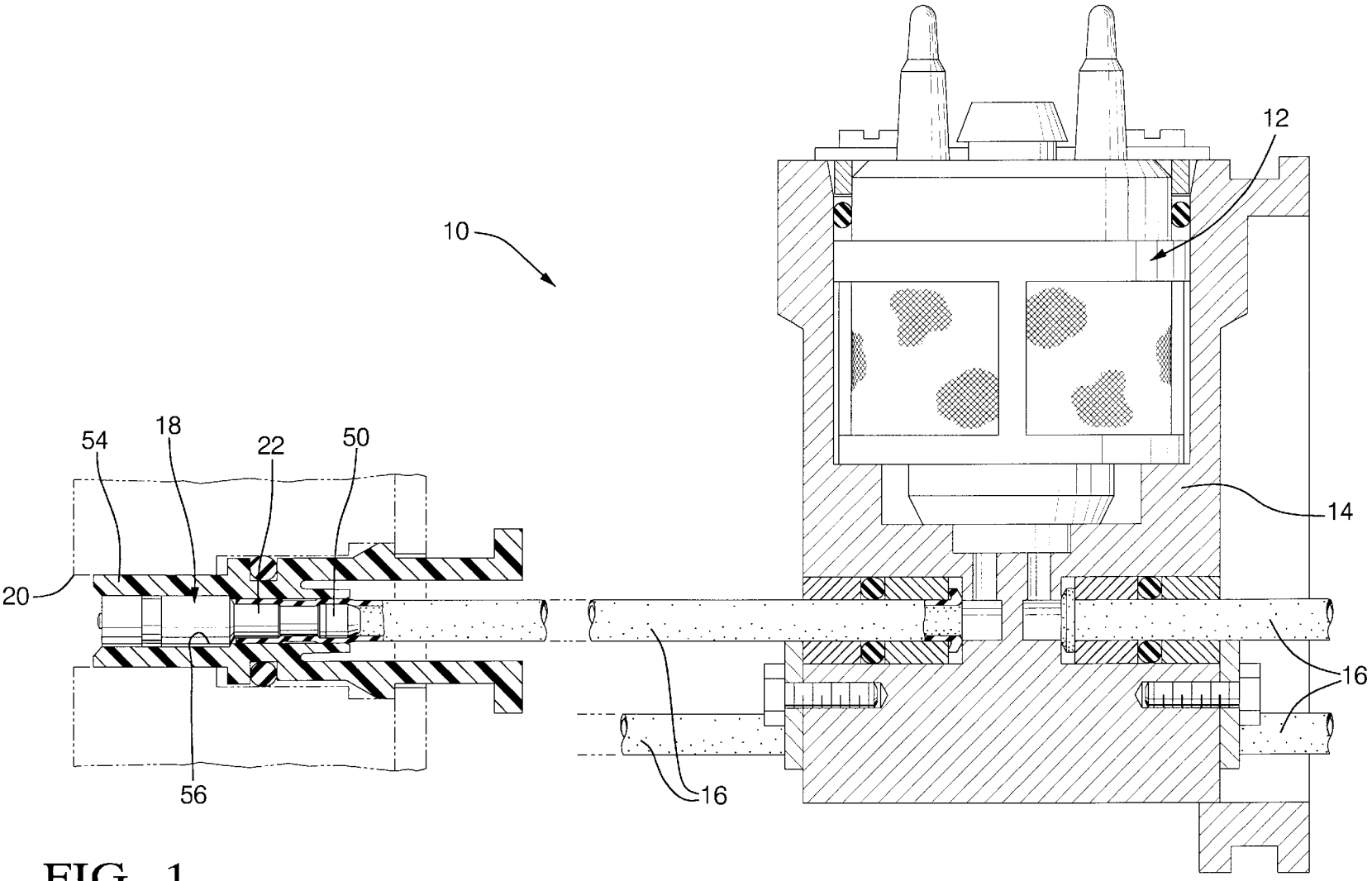
FIG. 1 shows a fuel injection system that meters fuel through a fuel line to a nozzle employing features of the present invention.

In FIG. 1 there is illustrated a fuel injection system, designated generally as 10, useful to deliver finely atomized fuel to the intake system of an internal combustion engine, not shown. An electromagnetic fuel injector 12 is mounted in a fuel manifold or metering body 14 which is supplied fuel at a desired pressure. The fuel injector 12 meters the fuel, in the form of pressure pulses, to one or more fuel distribution lines 16. Each fuel distribution line 16 terminates at a fuel injection nozzle 18 that operates to discharge the metered fuel into the combustion air flowing through an intake manifold inlet port 20 to a combustion chamber of the engine.

Figure 2:
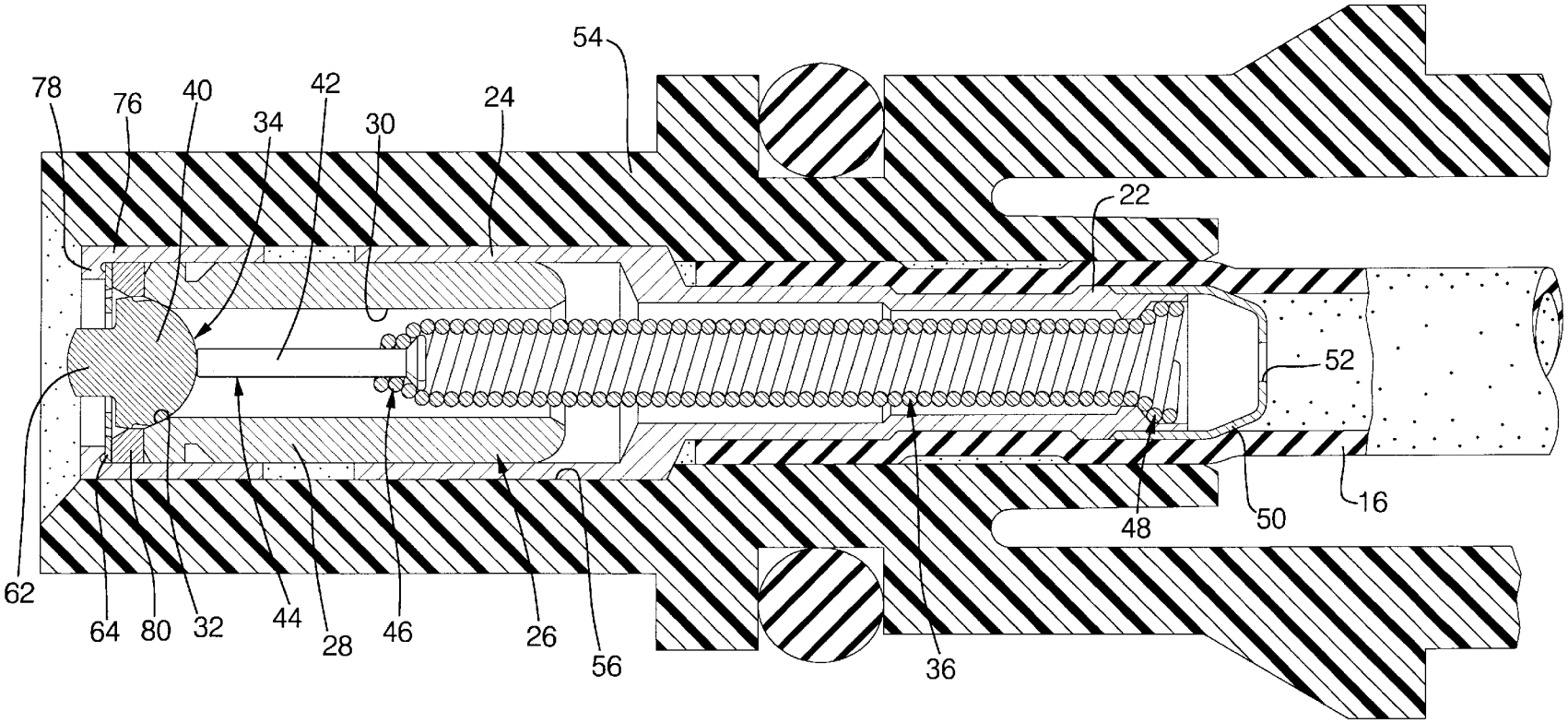
FIG. 2 is an enlarged, sectional view of a portion of the nozzle shown in FIG. 1 showing details of its construction.

As shown in FIG. 2, fuel injection nozzle 18 has a tubular body 22 adapted to receive fuel from an associated fuel line 16. The downstream end of the tubular body 22 has an enlarged diameter portion 24 which is configured to receive a tubular valve seat assembly 26. The valve seat assembly 26, shown in greater detail in FIGS. 3 and 4, includes a tubular valve seat body 28 having an outer wall which is configured for sliding engagement within the enlarged diameter end portion 24 of the tubular body 22. The valve seat body 28 is fixed within the enlarged portion 24 such as with an interference fit between the two components, or by welding or otherwise bonding, so as to establish a leak-free seal at the interface therebetween and to support the valve seat assembly 26 within the tubular nozzle body 22. An axially extending fuel passage 30 extends the length of the valve seat body 28 and opens, at its downstream end, through a valve seat 32. A poppet valve member 34 is engageable with the valve seat 32 to interrupt fuel flow through the axial fuel passage 30, and a helically coiled extension spring 36 anchored to the tubular body 22 and to the valve member 34, biases the valve member 34 to engage the valve seat 32 in a normally closed fashion. When the fuel pressure differential across the valve member 34 reaches a desired level, the valve member is displaced from the valve seat 32 and pressurized fuel is allowed to pass through the annular opening 38, FIG. 6, defined between the valve seat 32 and the opened valve member 34.

The poppet valve member 34 comprises a ball 40 which forms a valve element that is welded to a shank 42 of a pin 44. The head of the pin 44 is surrounded by a section of reduced coils 46 of the extension spring 36 to anchor the spring to the valve member 34. The other end of the extension spring 36 has a section of enlarged coils 48 that overlie a portion of the tubular body 22 to anchor the spring 36 thereto. The tubular valve seat body 28 is axially moveable, relative to the tubular body 22, to adjust the length of the extension spring 36 and, thus, the bias exerted by the spring on the valve member 34. This adjustment allows calibration of the pressure differential across the valve member 34 at which the valve member is displaced from the valve seat 32. A restriction member 50 is received over the inlet end of the tubular body 22 and includes a calibrated orifice 52 that is operable to limit the flow of pressurized fuel into the nozzle 18. An orifice in each nozzle 18 of a fuel system 10 will assure that fuel is distributed equally to each nozzle. A fuel distribution line 16 is slipped over the tubular nozzle body 22. A mounting bushing 54 has a central bore 56 that embraces portions of the fuel nozzle 18 and distribution line 16, and allows insertion of the assembly into an aperture in the wall of an inlet port 20 in the engine. Fuel distribution line 16 is preferably flexible, and bends to allow installation of the fuel system on to the engine. The fuel line is shown in the Figures as a straight tube only for convenience.

Figure 3:
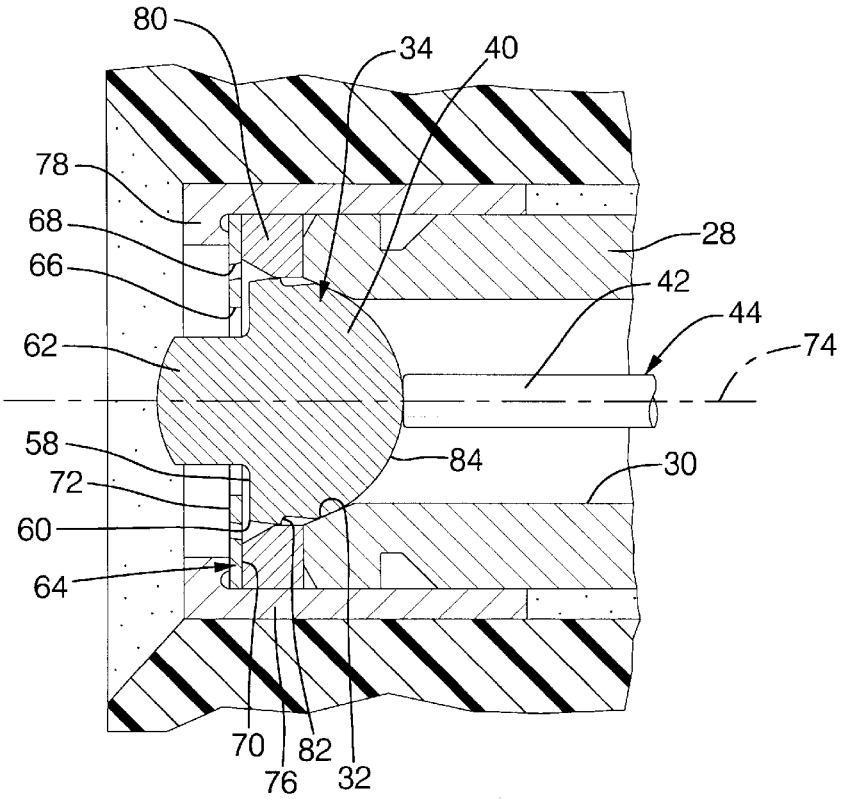
FIGS. 3 and 4 are enlarged partial sectional views of the nozzle of FIG. 2, illustrating various modes of operation.
Figure 4:
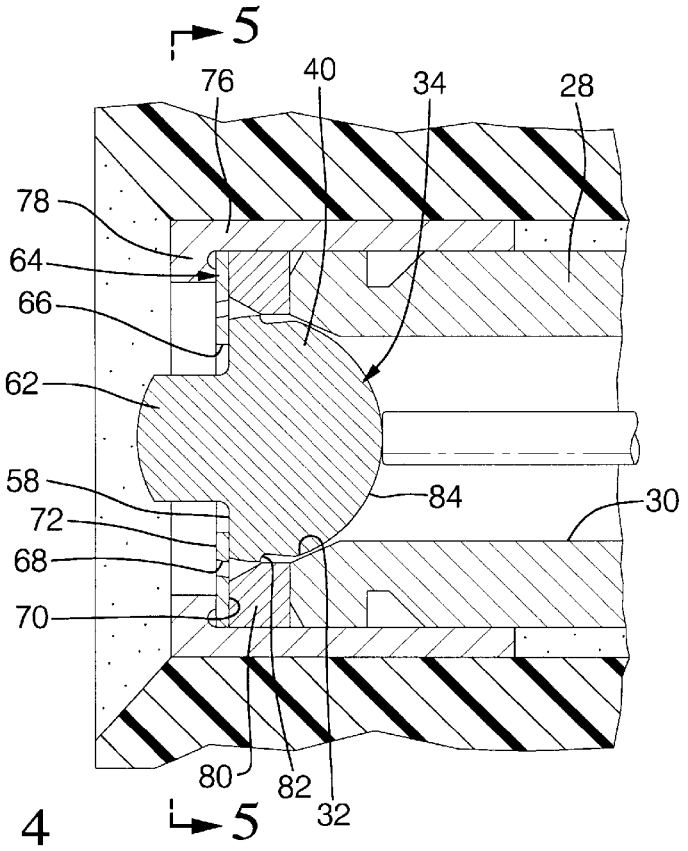
Figure 6:
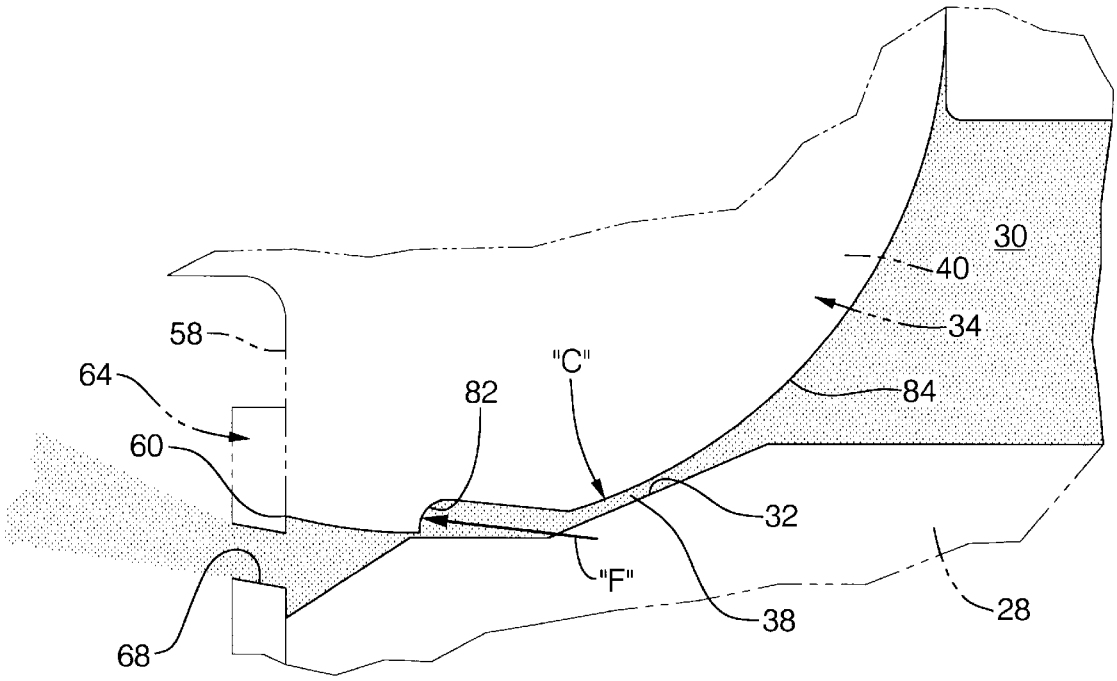
FIG. 6 is an enlarged schematic view of a portion of the nozzle of FIG. 2 illustrating fuel flow therethrough.

Referring to FIGS. 3, 4 and 6, the upstream portion of the valve ball element 40 is spherically configured so as to produce a fluid tight seal with the conically configured valve seat 32. Downstream of the seating portion the lower or downstream half of the valve ball element 40 is machined to produce an annular flat 58 which extends radially inwardly from an edge 60. The annular flat terminates at a downstream extending, axial positioning stub 62.

Figure 5:
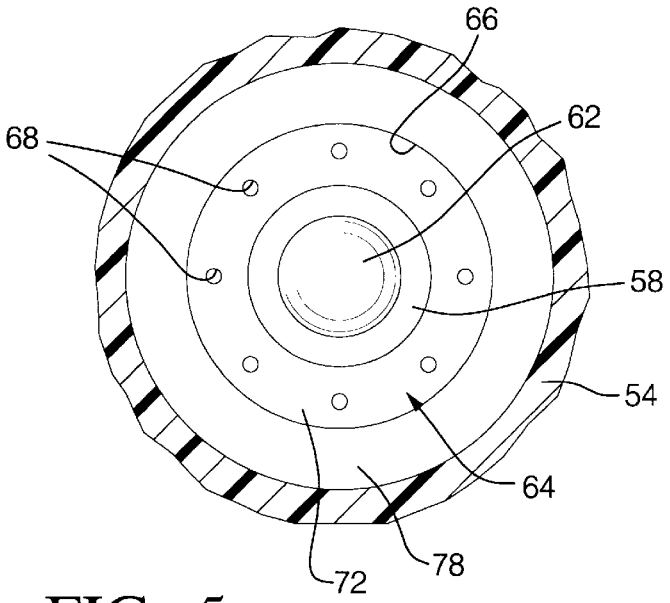
FIG. 5 is a sectional view of the nozzle of FIG. 2, taken along line 5—5 of FIG. 4.

An annular, ring shaped fuel directing orifice disc 64 is positioned down stream of the valve ball element 40 and includes a centrally located opening 66 positioned coaxially with the positioning stub 62 and having a diameter sized to receive the positioning stub therein. Circumferentially located about the annular disc 64 are a series of fuel orifices 68, FIG. 5, which extend through the disc from the upstream surface 70 to the downstream surface 72. The orifices may be angled, relative to the nozzle axis 74, so as to direct fuel exiting the nozzle in a desired spray pattern. The fuel directing orifice disc 64 is located adjacent, and downstream of the valve seat 32 and is positioned against the lower end of the tubular valve seat body 28 by a locating cap or sleeve 76 which is received over the terminal end of the valve seat body 28 and includes a radially inwardly extending, downstream flange 78 which positions the annular disc 64 against the seat body. In the embodiment of the fuel injection nozzle 18 shown, an axial spacing ring 80 is located between the terminal end of the valve seat body 28 and the annular, ring shaped fuel directing orifice disc 64 to define an axial range for movement of the valve member 34 off of the valve seat 32.

Referring to FIG. 6, the valve ball element 40 may include a ball drag groove 82 which is located about the circumference of the spherical portion 84 of the ball element 40, downstream of the valve elements line of contact "C" with the valve seat 32. The ball drag groove 82 increases the viscous drag force "F" imposed on the valve element 40 by fuel passing over the spherical surface 84 following the opening of the valve element off of the valve seat 32. The result of the increase in viscous force "F" on the valve element 40 is an increase in the opening acceleration and velocity of the valve member 34 during the opening event of the fuel injection nozzle 18. Such an increase in opening acceleration and velocity will allow an increase in axial valve stroke for a given response time over a typical valve element without such a feature. Shorter response times will result for a given valve stroke when compared to a valve element without such a force increasing feature. One benefit of an increase in attainable valve stroke is a decreased sensitivity of the poppet nozzle 18 to fuel contamination. In addition, the increased drag force brought about by the ball drag groove 82 on the valve element 40 is a lowering of the fuel pressure force which is required to fully open the valve 34. Such a reduction in opening force allows a reduction in fuel system supply pressure.

Upon introduction of a fuel pulse to the fuel injection nozzle 18, the valve member 34 remains in a normally closed position against the valve seat 32 under the influence of the extension spring 36 until the pressure differential across the valve element 40 reaches a level which can overcome the spring force and move the valve element off of its seated and closed position against the valve seat. Movement of the valve element 40 off of the valve seat 32 operates to define annular flow passage 38 between the valve member and the seat for the flow of pressurized fuel. The fuel flowing over the spherical surface of the valve element is subjected to a disruption by the annular drag groove resulting in an increase in the opening force exerted on the valve member in the downstream direction. As the valve element 40 reaches the end of its desired stroke range, the flat, radially inwardly extending surface 58 of the valve element 40 engages the upstream surface 70 of the annular, fuel directing orifice disc 64 so as to seal off fuel flow through the central opening 66, thereby forcing fuel flowing through the annular valve seat opening 38 to distribute across the upstream surface 70 of the annular fuel directing disc 64 where it flows through the fuel directing orifices 68 and out of the nozzle 18.

The downstream stop function of the annular, ring shaped fuel directing orifice disc 64, just described, provides a fuel metering function which reduces the sensitivity of the nozzle 18 to pressure variations in supply fuel pressure and component pressure drops over typical nozzle designs which do not incorporate a downstream stop feature while providing a precise fuel directing feature through the use of the fuel directing orifices 68. The orifices allow fuel spray configurations to be formed by the nozzle 18 which are not possible using modifications to the geometry of the valve ball element 40.

The present invention discloses a fuel injection nozzle having a valve assembly which utilizes a specially configured valve element and fuel director stop allowing the nozzle to exhibit significant insensitivity to fuel pressure variation, provide increased resistance to fuel contamination and provide precise fuel spray control.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiment may be modified in light of the above teachings. The embodiment described was chosen to provide an illustration of the principles of the invention and of its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. An fuel injection nozzle adapted to receive pulsed pressurized fuel from a source, comprising a valve seat assembly having a valve seat body with a longitudinally extending passage, said passage having an upstream end and a downstream end with a valve seat extending thereabout, a downstream opening valve element disposed within said longitudinally extending passage and operable to move into and out of sealing engagement with said valve seat to regulate the flow of pressurized fuel through said passage, an annular, ring shaped fuel directing orifice disc disposed downstream of said valve seat and including a central opening configured to receive a portion of said downstream opening valve element and fuel directing orifices extending therethrough from a first, upstream side to a second downstream side of said disc, said disc operable to limit downstream movement of said valve member and to direct fuel through said orifices into a desired fuel pattern.

2. A fuel injection nozzle, as defined in claim 1, said valve element having a spherical upstream surface operable to engage said valve seat, said spherical surface terminating in a radially inwardly extending annular shoulder defining at its radially inner edge an axially downstream extending positioning stub, said stub located coaxially with and in said central opening of said annular, ring shaped fuel directing orifice disc.

3. A fuel injection nozzle, as defined in claim 1, said valve member portion operable to close said central opening in said annular, ring shaped fuel directing orifice disc, upon movement thereof from a closed position against said valve seat to an open position thereagainst, thereby directing fuel, passing through said open valve seat, to said upper surface of said annular, ring shaped fuel directing orifice disc and through said fuel directing orifices.

4. A fuel injection nozzle, as defined in claim 2, said radially inwardly extending shoulder operable to close said central opening in said annular, ring shaped fuel directing orifice disc, upon movement of said valve element from a closed position against said valve seat to an open position thereagainst, thereby directing fuel, passing through said open valve seat, to said upper surface of said annular fuel directing orifice disc and through said fuel directing orifices.

5. A fuel injection nozzle adapted to receive pulsed pressurized fuel from a source, comprising a valve seat assembly having a valve seat body with a longitudinally extending passage, said passage having an upstream end and a downstream end with a valve seat extending thereabout, a downstream opening valve element disposed within said longitudinally extending passage and operable to move into and out of sealing engagement with said valve seat to regulate the flow of pressurized fuel through said passage, said valve element having a spherically configured upstream surface for sealing engagement with said valve seat, said surface including an annular drag groove extending about the perimeter thereof, said drag groove operable to increase viscous drag force, in the downstream opening direction, imparted on said valve element by fuel flow over said spherical upstream surface, and an annular, fuel directing orifice disc disposed downstream of said valve seat and including fuel directing orifices extending therethrough from a first, upstream side to a second downstream side of said disc, said disc operable to limit downstream movement of said valve member and to direct fuel through said orifices into a desired fuel pattern.

* * * * *